United States Patent [19]

Obonaga-Calle

[11] 4,134,239

[45] Jan. 16, 1979

[54] BURIAL FIELD AND METHOD OF CONSTRUCTING SAME

[76] Inventor: Tulio E. Obonaga-Calle, 1426 21st St., N.W., Washington, D.C. 20036

[21] Appl. No.: 788,997

[22] Filed: Apr. 19, 1977

[51] Int. Cl.[2] ..... E04H 13/00

[52] U.S. Cl. ..... 52/133; 52/742

[58] Field of Search ..... 52/128–142, 52/302, 742, 169.1, 169.6, 169.14, 742, 124, 137

[56] References Cited

U.S. PATENT DOCUMENTS

| | | | |
|---|---|---|---|
| 844,296 | 2/1907 | Winslow | 52/302 |
| 1,087,448 | 2/1914 | Holway | 52/131 |
| 1,094,600 | 4/1914 | Schaekel | 52/136 |
| 1,340,656 | 5/1920 | Hughes et al. | 52/134 |
| 1,641,123 | 8/1927 | Cullinan | 52/132 |
| 3,230,674 | 1/1966 | Christensen | 52/128 |
| 3,295,271 | 1/1967 | Dorris | 52/742 |
| 3,772,826 | 11/1973 | Ferver | 52/137 |

FOREIGN PATENT DOCUMENTS

| | | | |
|---|---|---|---|
| 634724 | 11/1927 | France | 52/137 |
| 695968 | 10/1930 | France | 52/136 |
| 744431 | 1/1933 | France | 52/137 |
| 984774 | 2/1951 | France | 52/141 |
| 5699 of | 1894 | United Kingdom | 52/128 |

*Primary Examiner*—James L. Ridgill, Jr.

*Attorney, Agent, or Firm*—Snyder, Brown & Ramik

[57] ABSTRACT

The construction and method of constructing a burial field involves forming one or more tiers of burial chambers from commonly shared wall sections placed on a concrete slab or floor. The wall sections form natural drainage for the field and cover sections not only accommodate for earth fill and grass but also natural drainage into a water reservoir. The reservoir provides irrigation for the fill and the construction is at least partially above ground.

15 Claims, 8 Drawing Figures

BURIAL FIELD AND METHOD OF CONSTRUCTING SAME

BACKGROUND OF THE INVENTION

Conventional burial techniques involve excavation of individual grave sites and the burial of the casket therein, after which the excavated soil is placed on top of the casket and ultimately a layer of sod is added. Such a technique is conventionally employed but it is inherently wasteful of space because only a single grave site may be located in any one spot and, furthermore, the grave sites must be spaced laterally from each other by an amount sufficient to preserve the integrities thereof.

The above conventional technique in addition does not provide an accepted procedure in areas where the water table level is close of the ground surface and, in such instances, conventional technique is to employ vault constructions which are partially or wholly above ground. Again, any such technique as this is inherently wasteful of space because sufficient room must be reserved on all sides of the vault for people to pass.

BRIEF SUMMARY OF THE INVENTION

Accordingly, it is principal concern in connection with the present invention to provide a method and structure for constructing a burial field or cemetery site which is characterized by the ability to utilize the available space to a maximum extent, and to provide properly sealed grave sites even in areas or regions where water table levels would preclude the conventional burial techniques.

In particular, the present invention embodies a method in which a water-impermeable slab or floor is utilized and which may be disposed substantially at the ground surface or therebelow but which provides the foundation upon which separate wall sections may be assembled providing a plurality of potential burial chambers disposed in closely packed relationship and which may be at least partially above the ground. The method also involves the concept of providing multiple tiers of grave sites by the stacking of the separate wall sections, thereby further increasing the efficiency of utilization of space. The method also involves the utilization of cover members on the uppermost tier of chambers which receive soil and suitable vegetation such as grass, provide natural drainage therefor, and which covers individually may be removed to expose a particular burial chamber with a minimum of effort while also allowing the replacement of such cover together with its associated soil and vegetation as described.

The invention is also directed to structural components which are utilized in the method as aforesaid. In particular, the wall sections which rest upon the floor or slab form natural drainage passages by virtue of their physical construction and also provide interfitting joint means along their top edges so that the stacking of wall sections is permitted where desired. Further, the wall sections are so configured as to provide support means either for covering tiles which separate tiers of chambers or to support the cover member which ultimately form the permanent top for the construction.

The construction of the components is such as renders them easily sealed in airtight manner at the time a particular chamber is being prepared for utilization. Moreover, the construction is such that normal calking techniques may be employed throughout to impart the impermeability to each vault or chamber thereby to preclude the necessity for highly skilled labor for erecting or maintaining the system.

BRIEF DESCRIPTION OF DRAWING FIGURES

DETAILED DESCRIPTION OF THE INVENTION

Figure 1:
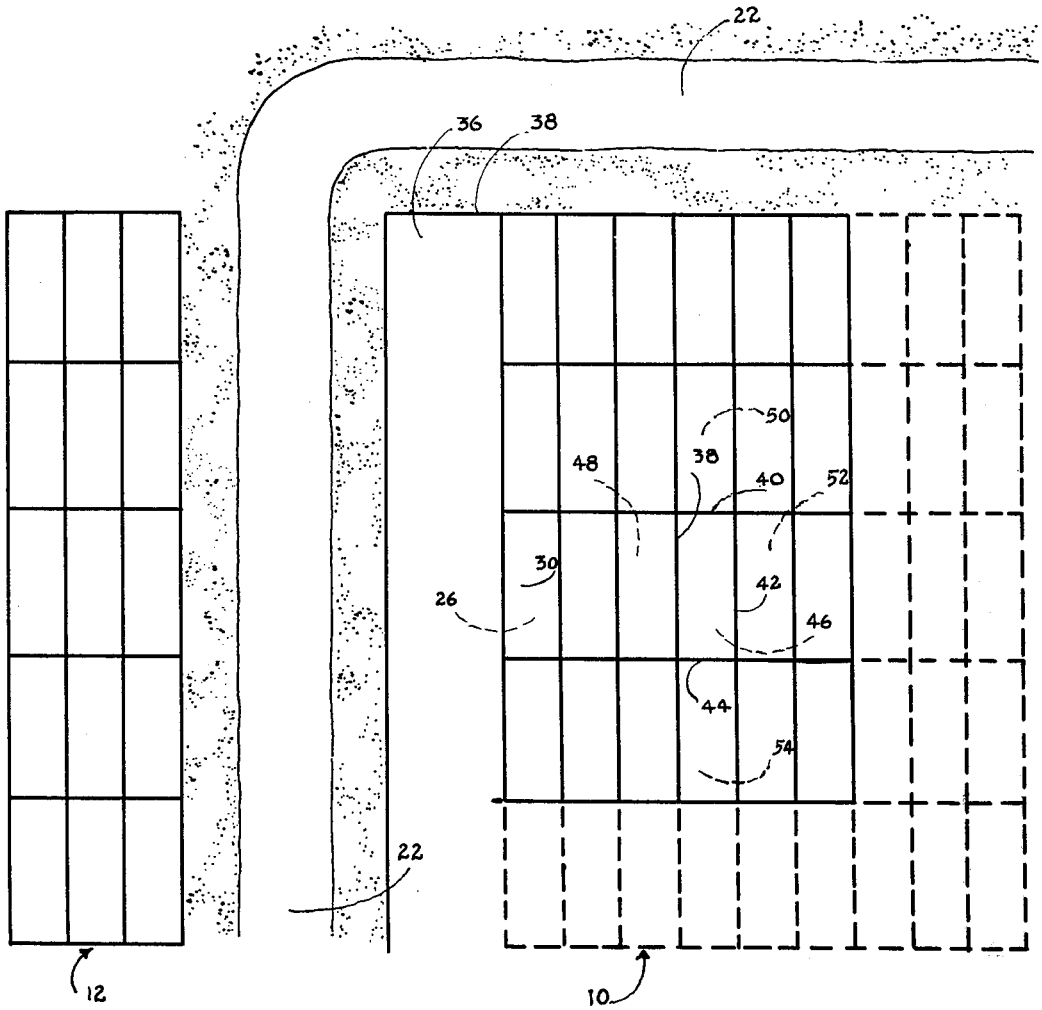
FIG. 1 is a diagrammatic plan view of a cemetery field constructed in accordance with the present invention.

Referring at this time more particularly to FIG. 1, a burial field constructed in accord with the present invention is indicated therein generally by the reference character 10 and a further burial field is illustrated by the reference character 12. The method and construction according to the present invention lends itself well to the construction of the fields 10 and 12 at or substantially at the original ground surface which is indicated by the reference character 14 in FIG. 2. Normally, the sod would be removed from the original ground surface 14, the fields 10 and 12 would be erected and thereafter soil 18 would be disposed in covering relationship to the field or fields and, where desired, an intermediate fill area 20 would be provided to present an elevated roadway or surface 22 to permit access for vehicles or pedestrians without encroaching upon the actual burial sites contained in the fields 10 and 12.

Figure 2:
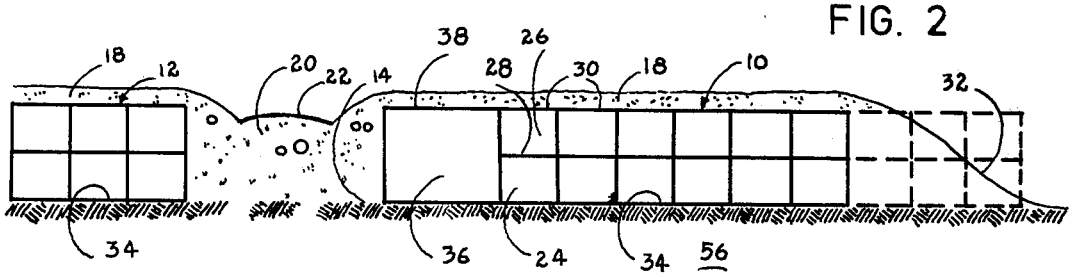
FIG. 2 is a diagrammatic view illustrating a vertical section taken through the field of FIG. 1.

Thus, one ordinarily would first remove the sod from the predetermined area upon which the field is to be erected and this sod placed aside for ultimate covering over the earth or soil 18 as previously described. In FIGS. 1 and 2, rectangular burial chambers are indicated as for example the chambers 24 and 26 and the field may be constructed of one or more tiers of such chambers, two tiers being illustrated in particular in FIG. 2. Between the chamber 24 and the chamber 26 in each case is a intermediate cover structure 28 and placed upon the chambers of the uppermost tier are cover members such as is indicated by the reference character 30. It is a particular feature of this invention that the cover members 30 also serve to retain the soil 18 and provide natural drainage therefor as will be set forth more particularly hereinafter. It will be also noted from FIG. 2 that the chambers represented by solid lines can be erected first and the earth fill sloped as indicated at 32 but as is also illustrated in FIGS. 1 and 2, subsequent construction of additional burial chambers may be effected as indicated by dashed lines in FIG. 2 and of course, in this event, the fill beneath the slope 32 is first removed, the further chambers constructed and then a new fill and slope provided over the additionally provided chambers.

Figure 8:
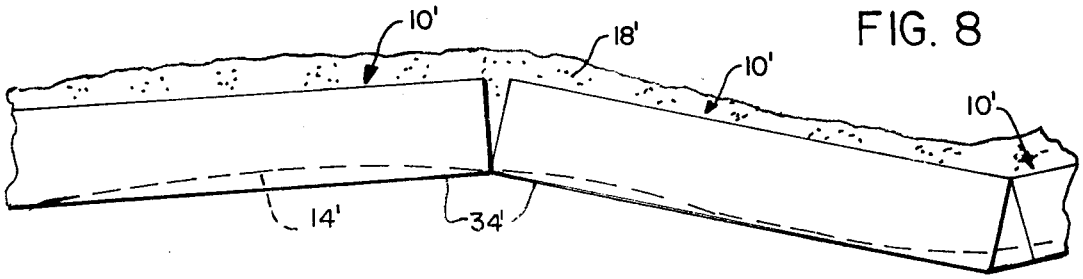
FIG. 8 is a view similar to FIG. 2 but illustrating the manner in which the burial field is provided to match or simulate the original ground contour.

A further feature of the present invention resides in the fact that the predetermined areas which covers the burial field 10 or 12 is first provided with a floor or slab 34 which consists of a layer of essentially impermeable material such as concrete and which provides the foundation support for the entire field. The slab may be flat where the original ground contours so dictate or the slab may be curved, undulated or otherwise provided within limits to match or simulate the original ground contour so as minimally to disrupt the overall terrain contour. Such an arrangement is shown in FIG. 8 wherein the original ground surface is illustrated by the dashed line 14'. The floor or slab 34' is undulated to simulate this ground surface within limits and the multiple-tiered fields 10' are provided as shown, and are covered with earth or soil 18' which returns the site to natural state but with an increased elevation of the original ground surface 14'.

In any event, the floor 34 will be so constructed as to provide a natural drainage or runoff in the particular instance illustrated in FIGS. 1 and 2, the slab or floor for the field 10 will be sloped somewhat to the left in these Figures to achieve drainage into the interior 36 of the water reservoir or tank 38 as will be described with greater particularity hereinafter.

Basically, the chambers 24 and 26 are formed by placing common wall sections such as those indicated by reference characters 38, 40, 42 and 44 in FIG. 1 so as to provide common wall structures not only for the chamber 46 which is bounded by these wall sections but also for the surrounding chambers 48, 50, 52 and 54. This in itself provides for great economy in space as will be evident more particularly hereinafter.

In many localities where there is a paucity of natural rainfall, the drainage provided by the covers 30 into the interior 36 of the water reservoir tank 38 provides excellent means for irrigating the sod overlying the covering soil layers 18. It is also to be noted that the construction provides a relatively shallow layer of soil 18 which does not require as much water for irrigation thereof as would be the case were the structure to allow drainage into the underlying soil structure 56, see particularly FIG. 2.

Figure 3:
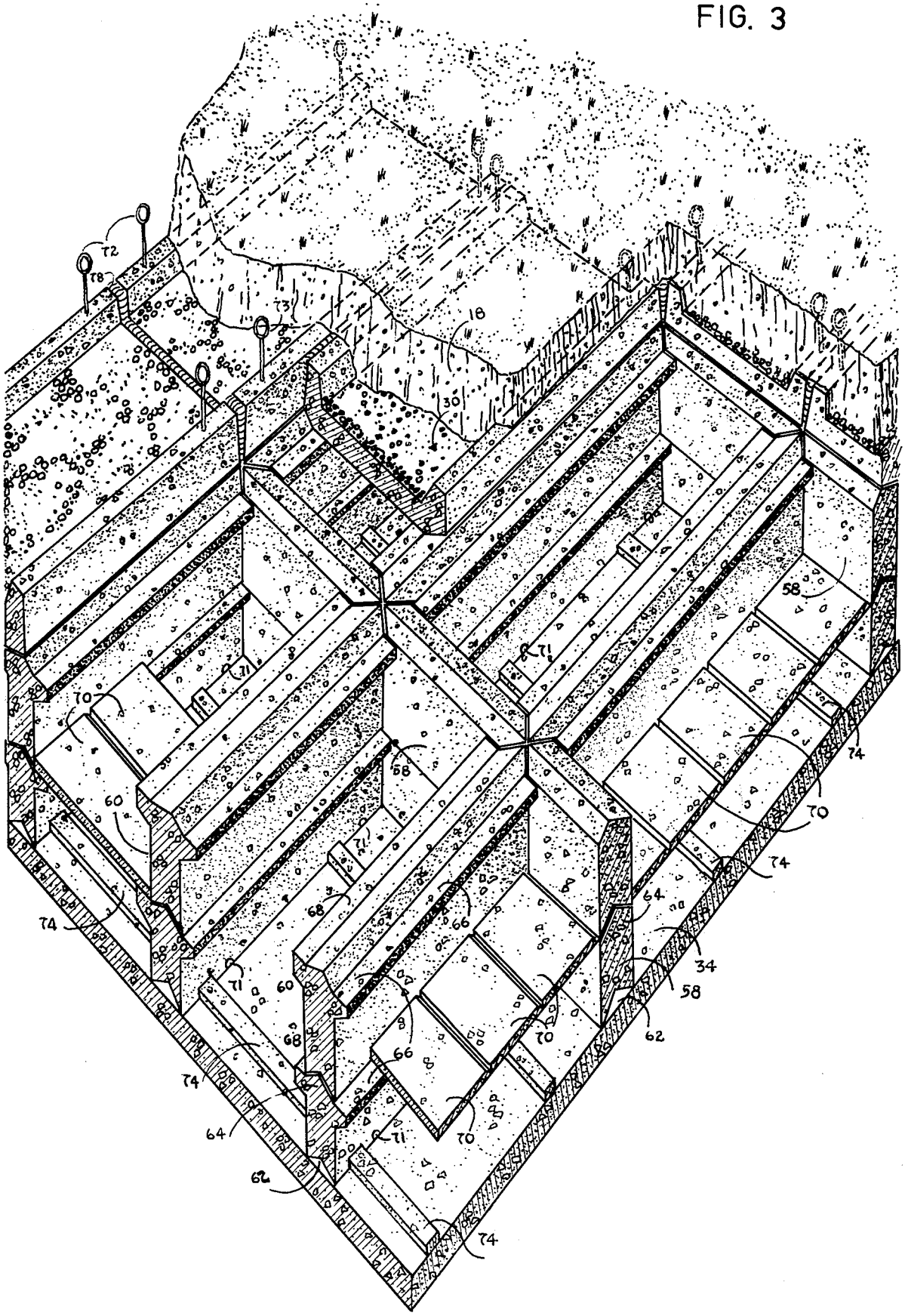
FIG. 3 is a perspective view partly broken away to show details of the construction.

Details of construction will be evident more particularly from FIG. 3 to which reference is now had. The floor or slab 34 will be seen to present the foundation for the field and in the particular instance illustrated in FIG. 3 there are two tiers of burial chambers. In order to form these burial chambers, two different types of wall sections are required, those such as are indicated by the reference characters 58 and those represented by the reference characters 60. The lower or bottom edges of each of the wall sections 58 and 60 are recessed as indicated by the reference character 62 so as to provide natural drainage channels in association with the floor structure 34 and also to allow the wall sections to be stacked as illustrated. For this purpose, the upper edge of each wall section is provided with a rib or ridge 64 and the superposed wall sections are simply stacked one upon the other as illustrated and do not require intervening martar or like material and consequently represent a very simple and efficient construction. As will be appreciated from FIG. 3, the wall sections 60 present ledges 66 and 68 on opposite sides thereof which are utilized for the lower tier of chambers, removably to support closure tiles 70 which are placed in position when the associated burial vaults are utilized. The uppermost tier of chambers is closed by individual and separate cover members 30 as previously described and it will be appreciated from FIG. 3 that these cover sections 30 overlie their respective upper tier chambers to close same off and to provide retaining means for the overlying soil 18, as shown.

The lower wall sections 58 and 60 may be provided initially with drainage openings such as those indicated by the reference characters 71 in FIG. 3 to allow water to drain from the interiors of the lowermost tier of chambers, but it is to be understood that when such a lowermost chamber is utilized, such openings 71 are sealed off by suitable putty or calking compound or the like.

That is to say, when a particular chamber is readied for use, access to it is gained by removing the overlying cover member 30 and, for this purpose, each cover member is provided with suitable pairs of hooks or eyes 72, 73 at its opposite ends. These are easily located beneath the covering soil 18 and the entire cover assembly is lifted bodily to expose the upper and lower chambers of the particular site with which the cover 30 is associated. Normally, at this time, the cover sections 70 would not be in place and the lowermost chamber of the site would then be prepared for reception of the casket. This is done by placing the support strips 74 which are laid in order to elevate the casket slightly above the surface of the floor 34 and the interior joints of the chamber are sealed with suitable calking compound to render the chamber substantially impermeable to air, openings such as 70 are closed, and after the casket is closed, the cover sections 70 are placed in position and calked all around and in between them thereby to complete the impermeable nature of the chamber. Then the cover section 30 is replaced and the next burial will be effected, for example, on the next uppermost chamber at the site. Illustrative calking compound joints 78 such as may be utilized to seal the interior joints of any particular chamber are illustrated between two of the cover members at the upper left of FIG. 3, it being appreciated that the construction according to this invention lends itself readily to the utilization simply of sealing or calking compound in the various joints without resort to the need for skilled masonry workers to effect the erection and preparation of the burial chambers.

Figure 5:
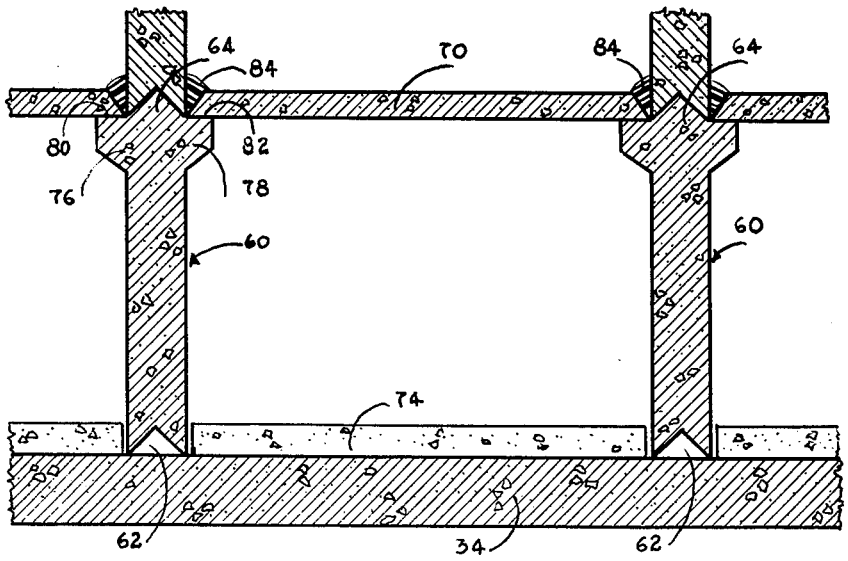
FIG. 5 is a vertical section taken through the assemblage shown in FIG. 4.

Details of construction of the wall section 60 can be seen more readily in FIG. 5, to which reference is now had. As shown, the ridges 64 along the top edges of the sections 60 may be of triangular configuration and the recesses 62 along the lower edges of the section 60 are similarly shaped, although it will be appreciated that other and different configurations may be utilized as desired. In any event, the ridge 64 of an underlying section 60 provides a saddle or seat received in the recess 62 of the next overlying wall section. Each wall section 60 is provided along its oppposite sides just beneath the ridge 64 with the oppositely extending and longitudinally projecting ledges 76 and 78. These ledges 76 and 78 provide the horizontal seating surfaces 80 and 82 which either support the cover tiles or sections 70 or the cover member 30. In FIG. 5, a lowermost tier of the chambers is illustrated and they are provided with the covers 70. FIG. 5 also illustrates the calking seams 84 associated with the cover sections 70.

Figure 4:
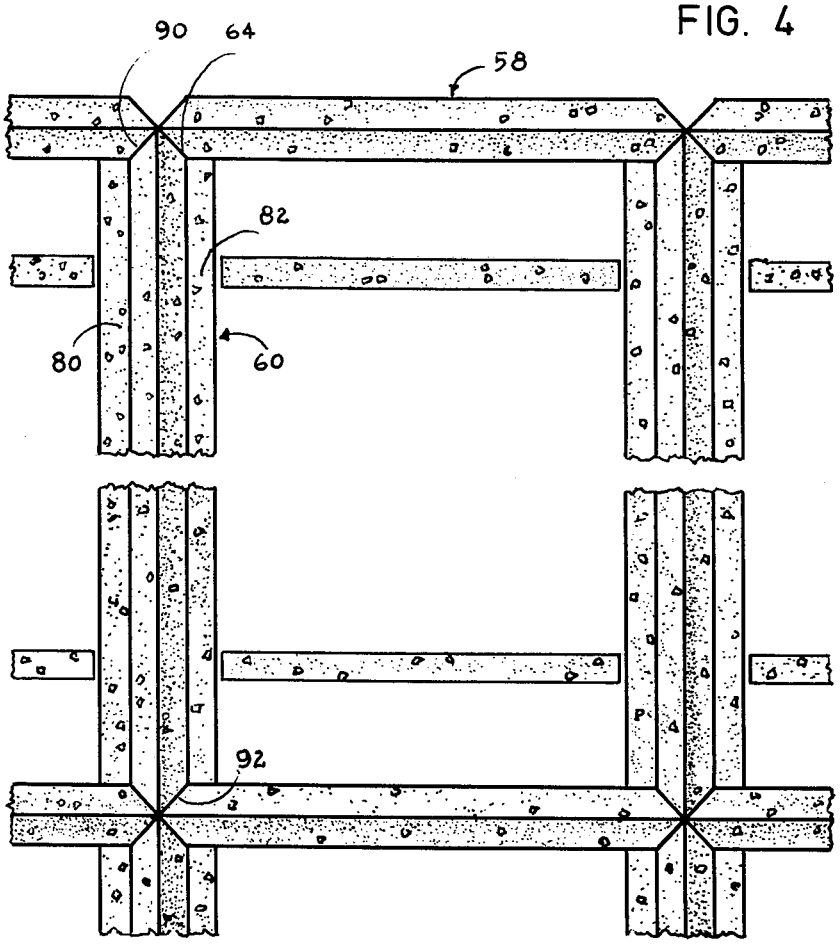
FIG. 4 is a plan view illustrating details of the constructional features according to the present invention.

As is illustrated in FIG. 4, the opposite ends of each of the wall sections 60 are mortised as indicated by reference characters 90 and 92 so that the corresponding ends of assoiated wall sections 58 and 60 interfit as shown.

Figure 6:
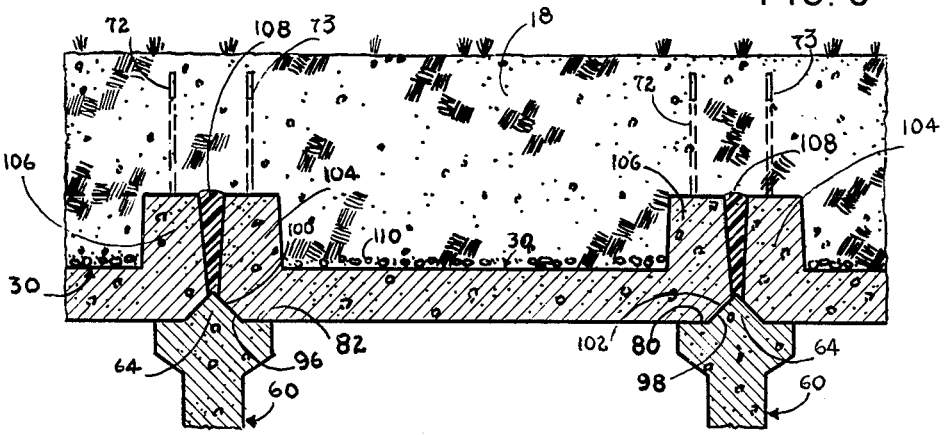
FIG. 6 is a vertical section illustrating certain details associated with the cover members.
Figure 7:
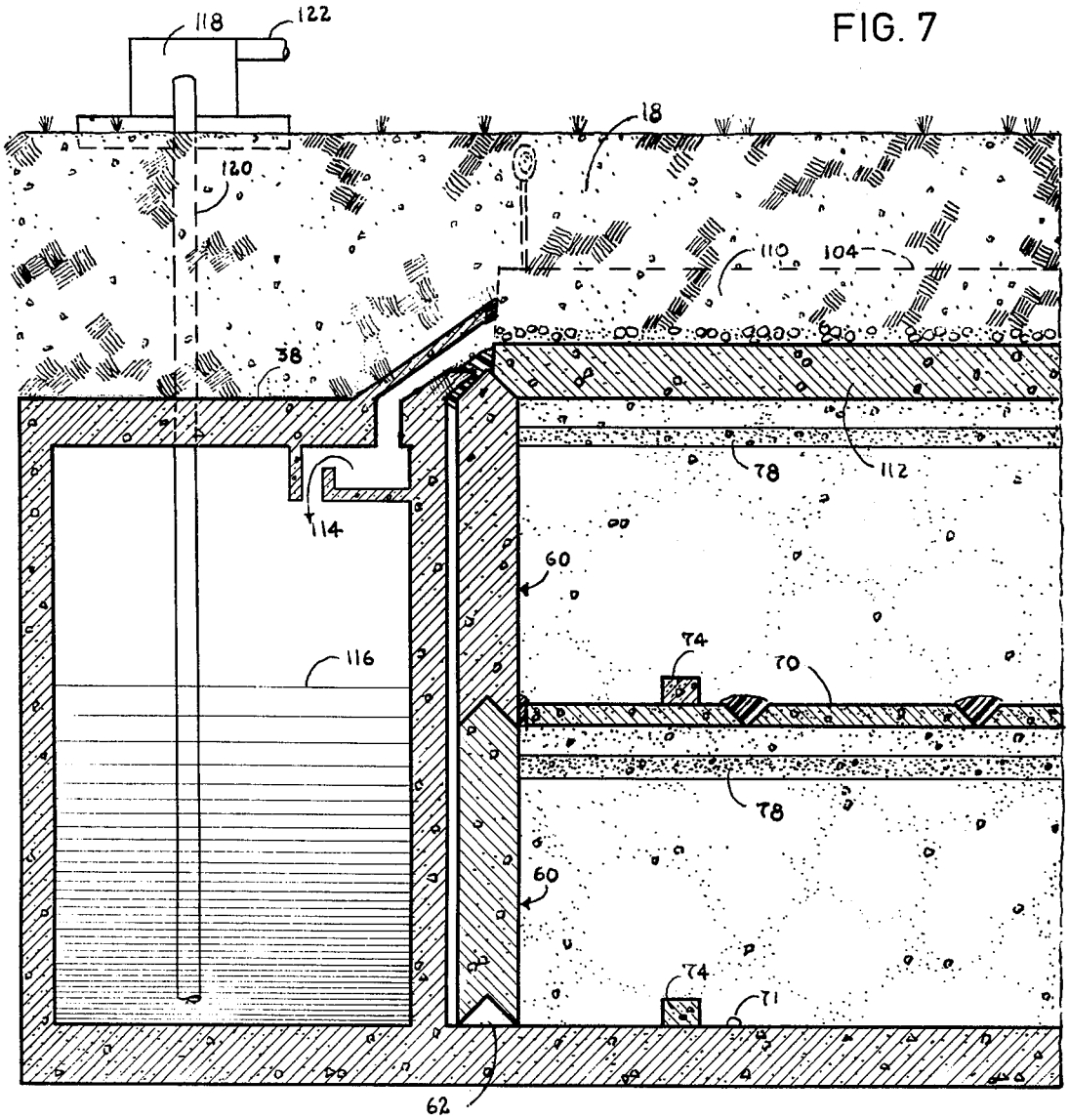
FIG. 7 is a sectional view illustrating further principles according to the present invention.

As is illustrated in FIG. 6, each cover section or member 30 is of trough-shaped configuration having beveled opposite side edges 96 and 98 interfitting with the corresponding apical surfaces 100 and 102 formed by the corresponding ridges 64 and being supported, along their opposite side edges by the ledge surfaces 80 and 82 as previously described. FIG. 6 also illustrates the manner in which the joints between corresponding opposite side wall portions 104 and 106 of adjacent cover sections 30 may be filled as by plastic or similar material 108 to preserve the impermeable characteristics of the burial field. FIG. 6 also illustrates how the natural drainage of each cover section 30 is enhanced by the preferable utilization of a layer of gravel 110 along the bottom surface thereof over which the soil 18 is placed and, in FIG. 7, is illustrated how this natural drainage may be utilized in conjunction with the tank 38 described previously in conjunction with FIG. 1 to achieve a reservoir effect from the natural drainage runoff from the soil 18. As is illustrated in FIG. 7, the bottom wall 110 of the cover section 30 may run in the direction toward the tank 38 or, alternatively, the side walls 104 and 106 of the cover sections 30 may be provided with through openings to provide lateral drainage, dependent upon the particular location of the tank 38 with respect to the chambers. The gravel 110 allows the water to drain off and flow in the direction of the arrow 114 into an opening or openings along the upper side of the tank 38 and enter the interior thereof to form the water reservoir 116. A suitable pump 118 has its intake conduit 120 extending into the tank 38 and the outlet 122 may be coupled to an irrigation system or the like for returning water back onto the surface of the soil layer 18 when desired.

What is claimed is:

1. The method of constructing a burial field which elevates the original ground surface while following the topography thereof and is characterized by efficient use of space, which comprises the steps of:

(a) removing the sod from a predetermined undulating area of the ground surface to present a stripped area which essentially follows the contour of the original ground surface;

(b) forming a water impermeable floor slab on said stripped area substantially at the original ground surface to provide an undulating floor slab essentially following the contour of the original ground surface, said floor slab having drainage pitch to create a natural water run-off;

(c) subdividing the area of said slab into a plurality of side-by-side casket receiving chambers by placing on said slab a first plurality of interfitting wall sections which define the boundaries of said chambers, and then stacking a second plurality of interfitting wall sections on said first plurality of wall sections whereby to provide at least two tiers of casket-receiving chambers;

(d) covering the upper tier of chambers by placing separate covers over each stack of chambers, whereby the entirety of said predetermined area presents multiple tiers of potential burial plots, with said two tiers and said covers being located above the original ground surface;

(e) covering those portions of the burial field which are disposed above the original ground surface with soil so that the whole of said area is returned to natural state following the undulations of the original ground surface but with increased elevation, and then covering said area with sod to complete the natural appearance of said area; and then (f) temporarily removing individual covers together with their sod to permit placement of a casket in an available site within a given plot, and then replacing said cover with its covering sod.

2. The method as defined in claim 1 including the step of stacking a further plurality of wall sections upon those constituting said upper tier when additional burial sites are required.

3. The method as defined in claim 1 wherein at least two floor slabs are formed in step (b), said floor slabs being disposed in spaced side-by-side relation whereby when the field is covered as in step (e), an access path is created between the burial chambers supported on the two slabs.

4. The method as defined in claim 1 wherein separate slabs are formed in step (b) with spaces therebetween defining a network of potential access paths within said area, whereby when the field is covered as in step (e), such access paths are created at the new ground level.

5. The method as defined in claim 1 including the step of providing intermediate covers on the lower tiers of chambers.

6. The method as defined in claim 5 including the step of sealing between said wall sections and said covers substantially to render each chamber water tight.

7. A burial field construction comprising, in combination:

a water impermeable floor slab having curvatures essentially following an original ground surface, and a plurality of interfitting wall sections supported on said slab to provide at least an above ground tier of burial chambers;

cover means interfitting with said wall sections of said above ground tier of burial chambers for providing individual covers for the burial chambers of such tier; and a soil cover over said burial chambers which returns the field to a natural state but with increased elevation of the original ground surface.

8. A burial field as defined in claim 7 wherein each cover presents a receptable for the earth fill.

9. A burial field as defined in claim 8 including plastic sealing means closing the joints of each chamber, when used, in airtight fashion.

10. A burial field as defined in claim 7 including a water reservoir adjacent said field, said cover means providing drainage into said reservoir.

11. A burial field as defined in claim 10 including pump means having an inlet communicating with said reservoir.

12. A burial field as defined in claim 7 wherein at least two tiers of burial chambers are provided by said wall sections.

13. A burial field as defined in claim 10 wherein each wall section is provided with a recess along its lower side edge and with a complementary ridge along its upper side edge.

14. A burial field as defined in claim 11 wherein at least two wall sections defining each chamber provide ledges for supporting said cover means.

15. A burial field comprising, in combination:

a water impermeable slab formed substantially at ground level and having curvatures essentially following the original ground surface;

a plurality of interfitting wall sections supported on said slab and forming at least one tier of burial chambers;

cover means interfitting with said wall sections for providing an airtight cover for said chambers, said cover means comprising individual covers each of generally trough-like configuration so that lines of covers provide natural drainage, and each cover having earth fill therein;

a water reservoir receiving water drained by said covers; and pump means for selectively irrigating the earth fill contained in said covers.

* * * * *